US011833709B2

(12) United States Patent
Ballweg et al.

(10) Patent No.: US 11,833,709 B2
(45) Date of Patent: Dec. 5, 2023

(54) STAVE, WOODEN BARREL WITH STAVES, AND METHOD FOR PRODUCING STAVES

(71) Applicant: Michael Weinig AG, Tauberbischofsheim (DE)

(72) Inventors: Josef Ballweg, Külsheim (DE); Albrecht Dawidziak, Großrinderfeld (DE); Frederic Colliou, Ballan Mire (FR); Hermann Schäfer, Ilmspan (DE); Klaus Weisenseel, Ahorn-Berolzheim (DE)

(73) Assignee: Michael Weinig AG, Tauberbischofsheim (DE)

( * ) Notice: Subject to any disclaimer, the term of this patent is extended or adjusted under 35 U.S.C. 154(b) by 486 days.

(21) Appl. No.: 17/126,165

(22) Filed: Dec. 18, 2020

(65) Prior Publication Data

US 2021/0187780 A1 Jun. 24, 2021

(30) Foreign Application Priority Data

Dec. 19, 2019 (DE) ..... 10 2019 009 022.5

(51) Int. Cl.
*B27H 3/02* (2006.01)
*B27H 5/02* (2006.01)
*B65D 8/00* (2006.01)

(52) U.S. Cl.
CPC ..... *B27H 3/02* (2013.01); *B27H 5/02* (2013.01); *B65D 9/04* (2013.01)

(58) Field of Classification Search
CPC ... B27H 3/02; B27H 3/00; B27H 5/02; B27H 5/00; B65D 9/02; B65D 9/04; B65D 11/06
USPC ..... 220/4.11, 4.09, 4.08, 4.04; 217/88, 72; 144/354, 345
See application file for complete search history.

(56) References Cited

U.S. PATENT DOCUMENTS

| | | | | |
|---|---|---|---|---|
| 8,288 | A * | 8/1851 | Chichester | B27H 3/02 147/25 |
| 1,162,995 | A * | 12/1915 | Fair | B65D 90/026 217/4 |
| 7,654,401 | B2 * | 2/2010 | Obergoenner | B65D 9/04 52/592.1 |
| 8,016,144 | B2 * | 9/2011 | Obergoenner | B65D 9/04 52/592.1 |
| 2006/0269358 | A1 * | 11/2006 | Obergoenner | B65D 9/04 403/381 |

FOREIGN PATENT DOCUMENTS

| | | |
|---|---|---|
| AT | 91 180 | 2/1923 |
| FR | 2 949 375 | 3/2011 |
| GB | 797 026 | 6/1958 |

* cited by examiner

*Primary Examiner* — Robert J Hicks
(74) *Attorney, Agent, or Firm* — Gudrun E. Huckett

(57) ABSTRACT

The staves for producing wooden barrels are assembled of individual segments which are fixedly connected to each other at end faces. The individual segments are shorter wood pieces that are assembled such that the stave has the required length. The wooden barrel is produced of such staves which are placed against each other seal-tightly with their narrow sides. The individual segments are machined at their end faces such that individual segments resting against each other after assembly are positioned at an angle relative to each other and form a raw stave that is curved across the length.

20 Claims, 5 Drawing Sheets

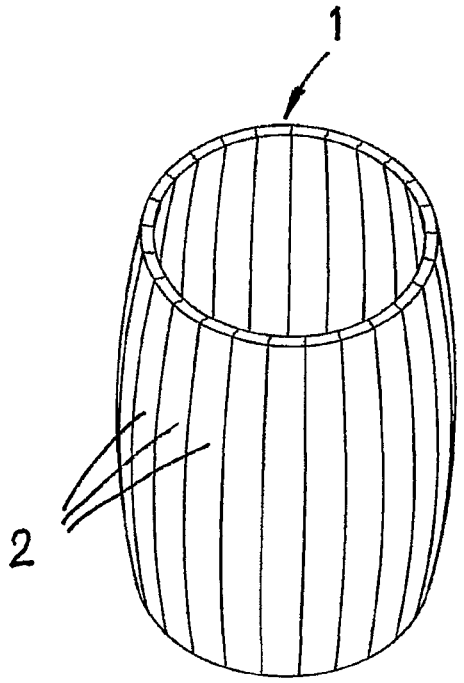
Fig. 1
Fig. 2
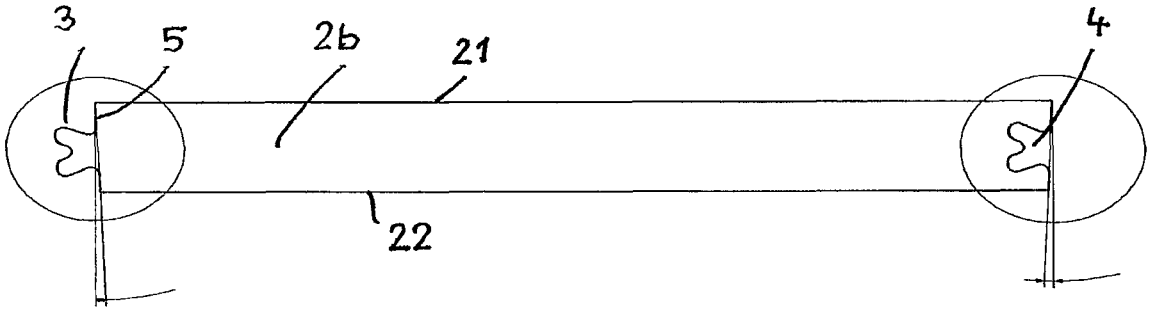

27
19
2
24
22
21
25
30
28
26
31
29
18

40
19
27
2
38
37
39
18

STAVE, WOODEN BARREL WITH STAVES, AND METHOD FOR PRODUCING STAVES

BACKGROUND OF THE INVENTION

The invention concerns a stave for producing wooden barrels, a wooden barrel with staves, as well as a method for producing staves.

It is known to form wooden barrels of curved staves that, with their longitudinal sides, rest tightly against each other. The staves extend across the height of the wooden barrel and are usually surrounded by a hoop at the upper and the lower end with which the staves are held together. The staves are in general split along the natural fibers of the wood. When producing barrels, they are brought by a steam bending method into a curved shape and held together with the hoops. When producing the wooden barrels, many remnants remain that are not used and constitute waste.

The invention has the object to produce the staves and the wooden barrels in a cost-efficient manner by saving raw materials.

SUMMARY OF THE INVENTION

The object is solved for the stave of the aforementioned kind in accordance with the invention in that the staves are assembled from individual segments that are connected to each other fixedly at end faces. For the wooden barrel, the object is solved according to the invention in that the staves according to the invention are placed against each other with their narrow sides in a seal-tight manner. In the method, the object is solved according to the invention in that the individual segments are joined together, contacting each other at end faces, to a raw stave.

The stave according to the invention is characterized in that it is assembled from individual segments which are connected to each other fixedly at end faces. The individual segments are shorter pieces of wood that are assembled such that the stave can have the required length for producing the wooden barrel. In this manner, remnants can be employed also so that the wooden barrels can be produced in a manner so as to save raw material. In general, the raw stave formed by joining together individual segments is too long. Prior to or after assembly of the raw stave, the respective terminal individual element is cut such that the raw stave has the desired length.

The individual segments are connected to each other in an advantageous manner at end faces by form fit. In this way, the individual segments are connected to each other fixedly to the stave. The form fit must act primarily in length direction of the stave with respect to the future loading and can be realized in various ways, for example, by a kind of dovetail connection or by so-called click profiles. Tongue and groove connections or finger joint connections are conceivable with use of a food-compatible adhesive as material-fused and friction connections.

In a simple configuration, the individual segments are of a straight embodiment.

In an advantageous embodiment, at least one end face of the individual segments is embodied so as to be inclined at an acute angle relative to a plane that extends perpendicularly in relation to an outer side of the individual segments. In this way, the individual segments are connected to each other by abutting each other such that they extend relative to each other at the angle of inclination of the end faces. When in this manner a plurality of individual segments are placed next to each other, then a stave will result that extends approximately in a curved shape across its length.

The form fit connection between the individual segments can be designed in an advantageous manner such that neighboring individual segments with their inclined end faces rest flat against each other. In this way, the staves that are formed of the individual segments have a high strength and stability. In particular, it is prevented in this way that the individual segments in the joining area separate from each other. The individual segments located at the two ends of the stave have advantageously at their free end face no form fit element but are designed planar, for example. These free end faces of the terminal individual segments form then the upper and the lower rim of the wooden barrel that is formed by the staves.

By means of the form fit connection, it is also possible in a very simple manner to connect the individual segments with sufficient seal-tightness to each other so that the contents of the barrel cannot escape through the form fit connections to the exterior.

It is possible to connect the connection between the individual segments with each other not only by form fit but in addition also with material fusion, for example, with an adhesive agent. Then a proper seal-tightness of the connecting regions between the neighboring individual segments is realized.

The staves can be placed flat against each other with their narrow sides extending in longitudinal direction during manufacture of the wooden barrels. However, there is also the possibility to provide at these narrow sides form fit elements with which neighboring staves are placed next to each other in a seal tight manner. In this way, a very high strength of the wooden barrel and a reliable sealing action are obtained.

The wooden barrel according to the invention is characterized in that it can be assembled efficiently and with raw material savings from staves which, in turn, are formed of individual segments. They can be assembled very easily and with minimal expenditure to staves.

In the method according to the invention, the individual segments that are formed by wooden parts are first joined together, contacting each other at end faces, to a raw stave. Depending on the embodiment of the end face connection, this can be done by pushing together and pressing together in transverse direction or, in case of a finger joint connection, with addition of an adhesive agent by compression in length direction. Joining together can be done by a machine, partially by a machine, or manually. When using a click profile, the individual segments are simply clicked together in length arrangement. The method according to the invention enables a simple, cost-saving, and material-saving manufacture of the raw staves.

A particularly simple method results when the individual segments are machined at end faces such that individual segments contacting each other extend at an angle relative to each other after joining. Due to the angled position of the individual segments relative to each other, a stave is provided that extends curved across its length.

Advantageously, straight wooden parts are used as individual segments. In this context, the curvature is not continuous but is comprised of individual straight sections that are positioned angularly relative to each other In an advantageous embodiment, the raw staves can be subsequently machined at their topside and at their bottom side in a throughfeed method for forming an outer or inner side that is convexly or concavely curved across its length.

The throughfeed method enables an efficient, fast, and inexpensive production of the stave.

The raw stave formed after assembly of the individual segments is transported with a first narrow side supported on a support through a processing machine. As it passes through, the two longitudinal sides of the raw stave that form the outer side and the inner side of the finished stave are machined with at least one tool, respectively. The two tools engage the raw stave at the oppositely positioned longitudinal sides. During passage of the raw stave, the two tools rotate about their axes and machine the two longitudinal sides at high speed. By means of the processing machine, an effective, fast, and precise machining of the raw staves is ensured.

Advantageously, with one tool the outer side which is convex transverse to the length direction is produced and with the other tool the inner side of the stave which is concave transverse to the length direction is produced. The corresponding tools have correspondingly a concave or convex working region.

Since the raw stave is curved across its length, the two tools during passage of the raw stave through the processing machine are moved transversely to the feed direction, controlled in accordance with the curvature of the raw stave, in order to obtain the desired curvature across the length of the raw stave.

Advantageously, the exposed second narrow side of the raw stave is machined in the same processing machine with at least one additional tool.

The raw stave is thus machined in one pass through the first processing machine on three sides.

The curved raw stave is transported linearly through the processing machine which accordingly can be of a simple construction.

For guiding the raw stave through the processing machine, at least one guide groove extending in the feed direction is advantageously introduced into the first narrow side. For this purpose, the processing machine can be provided, for example, with a lower horizontal spindle on which a groove milling tool is seated with which the guide groove can be milled into the first narrow side.

A guide web at the machine that extends in feed direction can engage the guide groove so that the raw stave that is curved in its length direction can be properly linearly transported by means of the feed elements through the processing machine.

After passing through the processing machine, the raw stave that has been machined on the three sides is turned such that the first narrow side provided with the guide groove is exposed and can be machined with a corresponding tool whereby also the guide groove is removed. Then the stave is finish-machined and can be used for producing the wooden barrel.

In order for a proper machining to be possible at this narrow side at the partially machined raw stave, the latter is guided at both longitudinal sides in the feed direction.

In this context, it is advantageous when the partially machined raw stave with its two ends is guided at a stop. It extends parallel to the feed direction and ensures that the partially machined raw stave is guided reliably during machining of its corresponding narrow side.

Also, it is advantageous when a guide that is extending in the feed direction is contacting the outer side of the partially machined raw stave that is convex between its ends.

The partially machined raw stave is thus properly supported between the stop and the guide during machining of the second narrow side.

The subject matter of the application not only results from the subject matter of the individual claims but also from all specifications and features disclosed in the drawings and the description. They are claimed, even if they are not subject matter of the claims, as important to the invention, provided they are individually or in combination novel in comparison to the prior art.

Further features of the invention result from the additional claims, the description, and the drawings.

BRIEF DESCRIPTION OF THE DRAWINGS

The invention will be explained in more detail with the aid of some embodiments illustrated in the drawings.

FIG. 1 shows in perspective illustration a wooden barrel according to the invention, produced from staves according to the invention, without cover.

FIG. 2 shows in an enlarged illustration and in a side view an individual segment of a stave according to the invention.

DESCRIPTION OF PREFERRED EMBODIMENTS

FIG. 1 shows in schematic illustration a wooden barrel 1 that is assembled of staves 2. They are curved across their length and are positioned with their narrow longitudinal sides liquid-tightly against each other in known manner. They are surrounded from the top end to the bottom end at the outer side by a plurality of hoops whereby the staves 2 are safely connected to each other.

The staves are assembled of individual segments so that a production of the wooden barrels 1 is possible that is efficient and saves raw material.

Figure 2A:
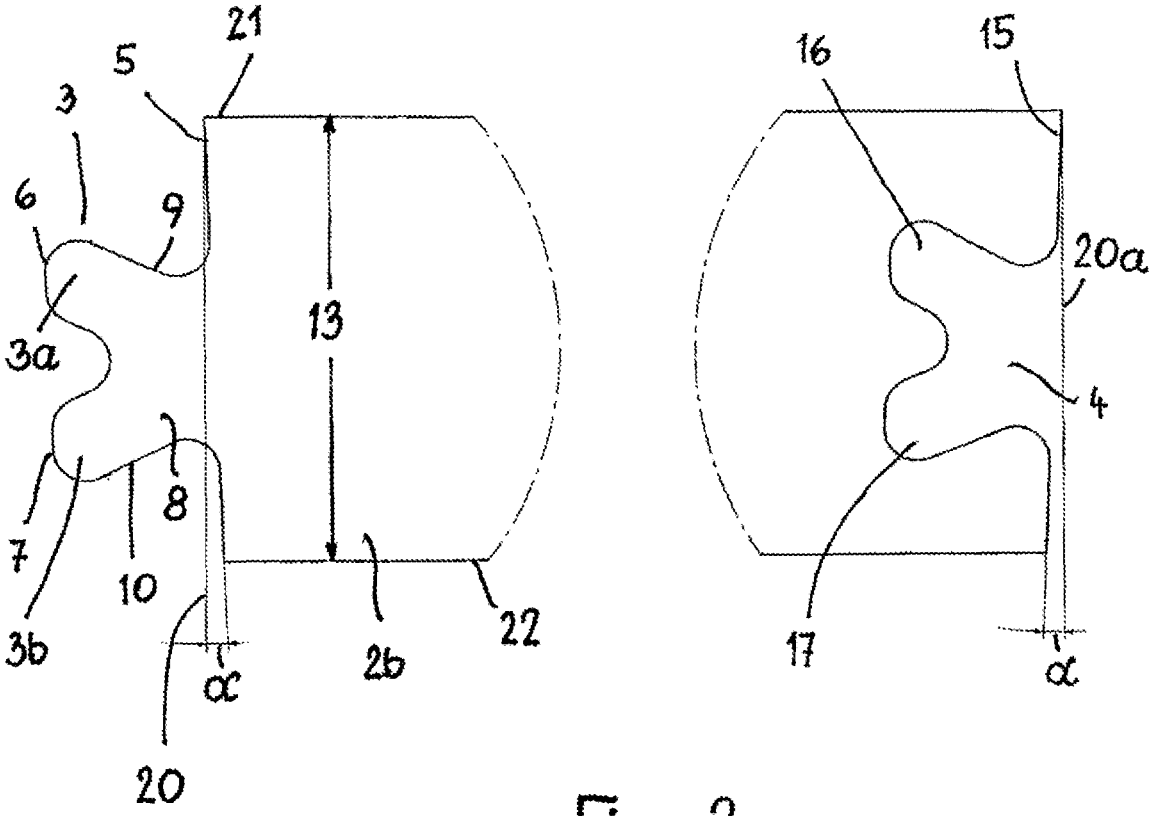
FIG. 2*a* shows in an enlarged illustration form fit elements provided at the ends of the individual segment according to FIG. 2.
Figure 3:
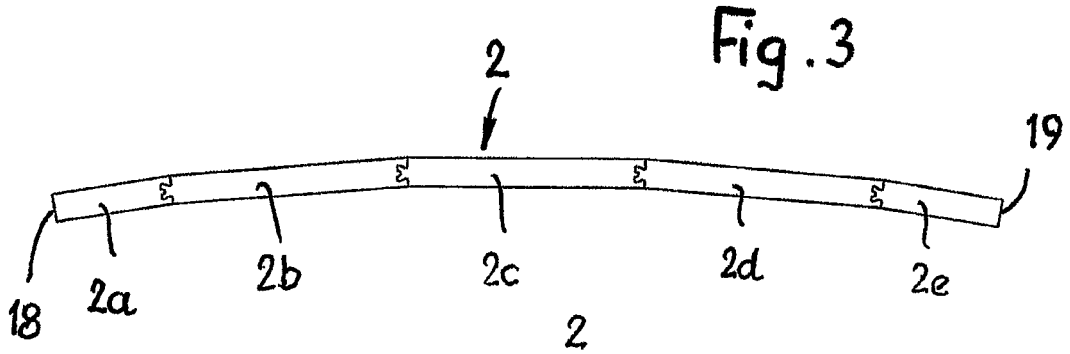
FIG. 3 shows in a side view a stave assembled of individual segments in the raw state.
Figure 4:
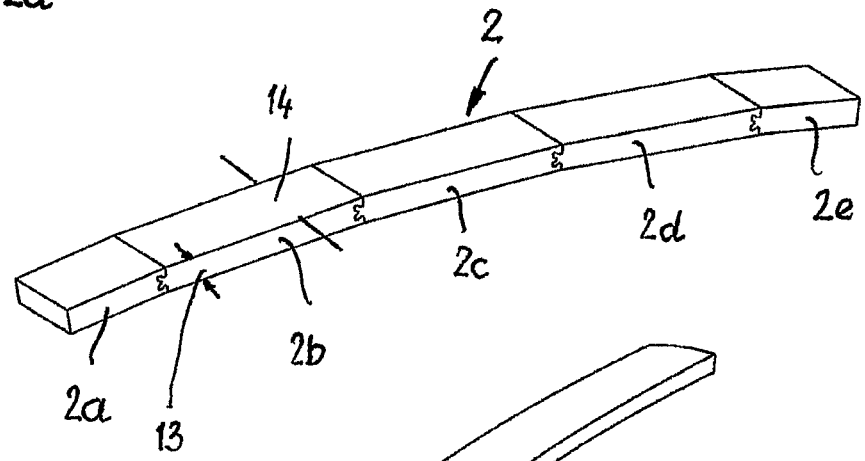
FIG. 4 shows in perspective illustration the stave according to FIG. 3.
Figure 5:
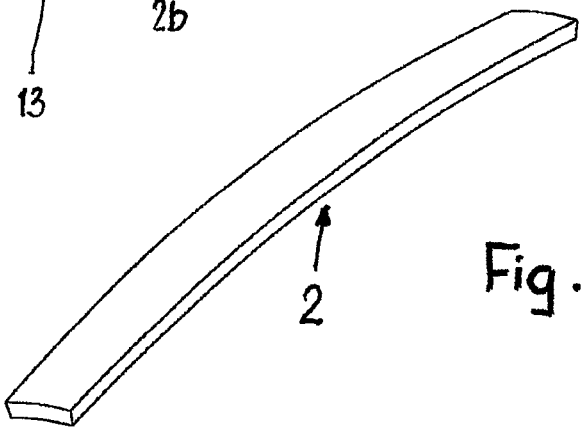
FIG. 5 shows in perspective illustration the stave according to FIG. 3 in machined state, wherein the separation lines between the individual segments placed next each other are not illustrated.

FIGS. 3 to 5 show in an exemplary fashion a stave 2 that is assembled of five segments 2*a* to 2*e*. They can have the same but also different lengths. In the illustrated embodiment, the individual segments 2*a* to 2*e* are embodied straight. They are connected to each other with form fit to the stave 2. The end faces 5, 15 with which the segments 2*a* to 2*e* abut each other are angularly configured which will be described in the following with the aid of FIG. 2. The segments are pre-planed advantageously at four sides and cut to length.

FIG. 2 shows one of the segments that is provided at both end faces 5, 15 with a respective form fit element 3, 4. The two form fit elements 3, 4 are of complementary configuration and form within the stave 2 a dovetail connection between neighboring segments.

The form fit element 3 projects past the end face 5 of the segment 2*b* and has two diverging projections 3*a*, 3*b* with aligned end faces 6, 7. Both projections 3*a*, 3*b* project away from a foot section 8 adjoining the end face 5 of the segment 2*b* whose sidewalls 9, 10 pass in opposite direction to each other continuously curved into the end face 5 of the segment 2*b*. The transitions of the sidewalls 9, 10 to the end face 5 and the end faces 6, 7 of the projections 3*a* and 3*b* as well as the projections 3*a*, 3*b* are each provided with radii.

The foot section 8 of the form fit element 3 is positioned advantageously at approximately half the thickness 13 of the segment 2*b*. The foot section 8 has such a thickness that the segments 2*a* to 2*e* placed next to each other have a sufficiently high strength.

The form fit elements 3 extend across the entire width 14 of the segments (FIG. 4).

The form fit element 4 which is located at the other end face 15 of the segment 2*b* is formed as a recess which is complementary to the form fit element 3 (FIG. 2*a*). For receiving the projections 3*a*, 3*b* the form fit element 4 is provided with correspondingly shaped and arranged recesses 16, 17. In the inserted position, the form fit element 3 is contacting with its outer contour the inner contour of the form fit element 4.

As illustrated in FIG. 3, the segments 2*b* to 2*d* have the design as described with the aid of FIG. 2 and FIG. 2*a*. The two segments 2*a*, 2*e* at the ends of the stave 2 have only at one end face the projecting form fit element 3 or the form fit element 4 embodied as a recess. In this way, the stave 2 is provided with a closed end face 18, 19 at both of its ends.

Since the stave 2 is of a curved configuration across its length, the end faces 5, 15 of the abutting segments 2*a* to 2*e* are embodied at an angle to the outer side of the segments which will be explained with the aid of FIG. 2*a*.

The end face 5 which comprises the form fit element 3 is positioned at a small acute angle α relative to a plane 20 (FIG. 2*a*) extending perpendicularly to the top and bottom sides 21, 22 of the segment 2*b*.

The oppositely positioned end face 15 of the segment 2*b* is inclined at the same angle α relative to a plane 20*a* which is extending perpendicularly to the top and bottom sides 21, 22 but in opposite direction in comparison to the end face 5.

When the segments 2*a* to 2*e* are joined together to the stave 2, neighboring segments are positioned at an inclination at the angle α relative to each other. The magnitude of the angle α determines the curvature of the stave 2 that is to be produced from the segments 2*a* to 2*e*. This curvature of the stave 2 can be taken from FIGS. 3 to 5. In the finished barrel, the curvature of the stave results from the height of the barrel and the dimension of its bulgy shape. In order to produce the raw stave in the length ready for installation and with the curvature ready for installation, the number of the segments and the angle α must be appropriately selected.

Since the segments 2*a* to 2*e* each are straight, the stave 2 which is assembled of the segments has a discontinuous shape in the raw state. In order to provide the stave 2 with a continuously curved shape across its length, the stave 2 which is illustrated in the raw state in FIGS. 3 and 4 is further machined after joining together.

Due to the described configuration of the form fit elements 3, 4 with the continuously curved contour transitions, neighboring segments can be joined together such that their end faces 5, 15 and form fit elements 3, 4 are abutting each other flat and a high seal tightness of the form fit connections is ensured.

Based on FIGS. 6 to 9, machining of the stave 2 in the raw state is described. The machine employed for machining the stave 2 is only schematically illustrated. This machine is a throughfeed machine in which the staves 2 are machined at their sides during their transport through the machine.

The staves 2 are resting with a narrow side 23 on a machine table (not illustrated) during their transport through the machine. For feeding the stave 2 through the machine, corresponding feed elements such as feed rollers are provided that load the staves 2 resting on the machine table against the machine table and convey them in feed direction.

Figure 6:
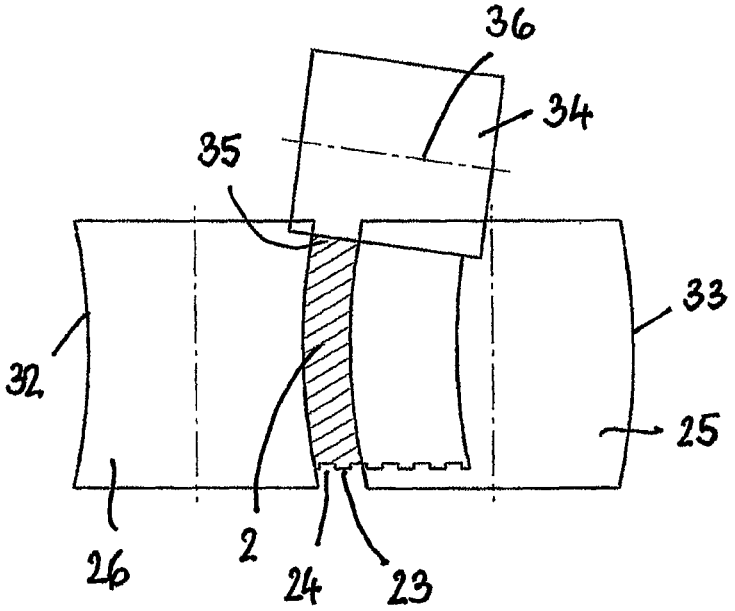
FIG. 6 shows in simplified illustration three tools for machining the stave.

The machine has in the in-feed region a lower horizontal spindle on which a tool is fixedly seated with which at least one groove 24 is milled into the narrow side 23 (FIG. 6) resting on the machine table. As can be seen in FIG. 6, several parallel extending grooves 24 are milled into the narrow side 23 of the stave 2. In the region of the lower horizontal spindle, the machine table is interrupted so that the tool seated on it can m ill the grooves 24.

In the feed direction behind the lower horizontal spindle, the machine bed of the machine is provided with projecting webs extending in the feed direction which engage the grooves 24 and in this way guide the stave 2 during its passage through the machine.

Figure 8:
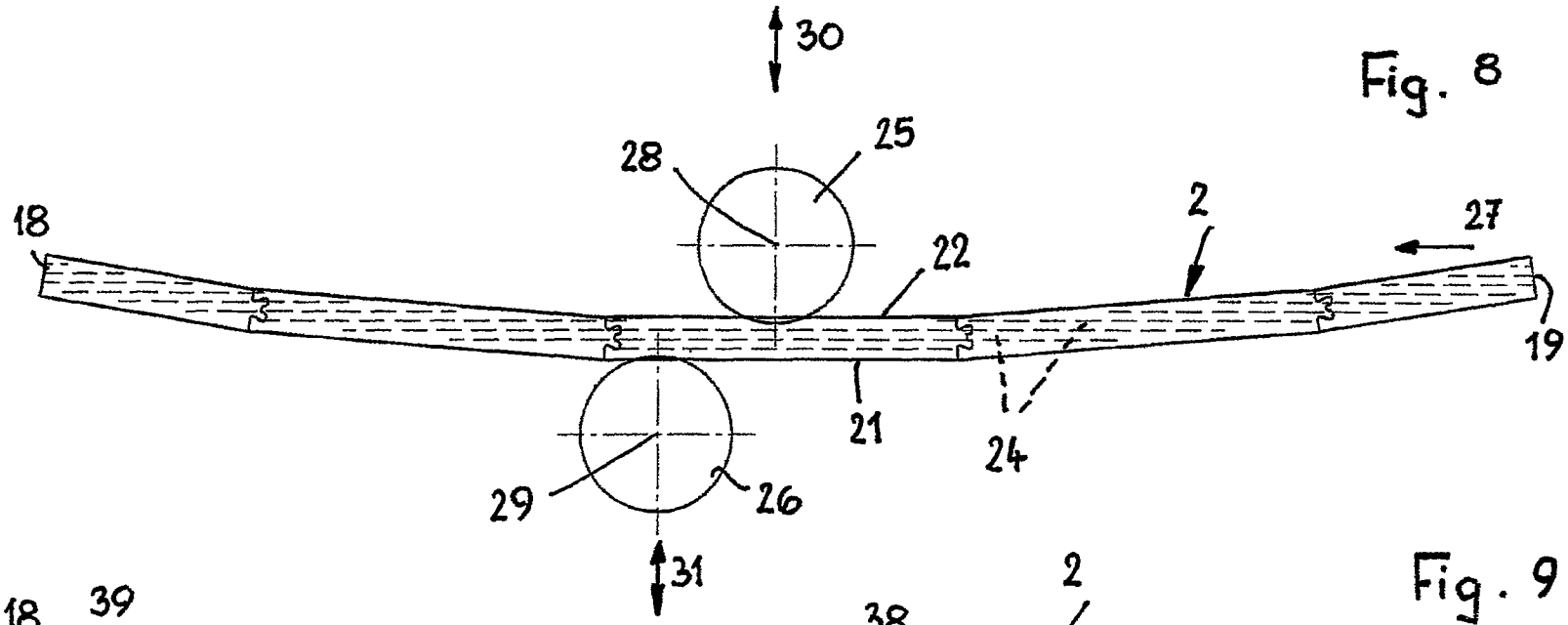
FIG. 8 shows in schematic illustration machining of the stave according to the invention on a first processing machine.

FIG. 8 shows a plan view of the stave 2 that is not yet machined whose longitudinal sides 21, 22 which form the top side and the bottom side are processed by a right tool 25 and a left tool 26. Both tools 25, 26 are seated fixedly on vertical spindles which are driven in rotation as the stave 2 is fed through in the feed direction 27. The grooves 24 extend parallel to the feed direction 27.

The axes of rotation 28, 29 of the tools 25, 26 as well as their engagement regions at the stave 2 are positioned advantageously in feed direction 27 at a minimal distance behind each other or opposite each other. In this way, a high machining precision is obtained.

Both tools 25, 26 are profiling tools with which the longitudinal sides 21, 22 are milled with the contour that is convex or concave in transverse direction.

When the staves 2 are assembled to the wooden barrel 1, the longitudinal sides 21, 22 form the outer side and the inner side of the stave 2.

Both tools 25, 26 are adjustable in a controlled manner transverse to the feed direction 27 in an adjusting direction 30, 31 so that they can produce the curved shape as the stave 2 is fed through the machine.

In this context, in known manner the transport path of the individual stave through the machine is recorded and the tools 25, 26 are adjusted by the machine control in accordance with the predetermined curvature in such a way that the staves 2 after processing have the desired continuously curved outer side and inner side.

The adjustment movement of the tools 25, 26 takes into consideration the thickness 13 of the stave 2 so that only so much material is removed that the stave 2 has a sufficient thickness across its length.

As can be seen in FIG. 6, the left tool 26 with which the outer contour of the stave 2 is produced is designed such that it has a concavely curved milling region 32.

The right tool 25 with which the inner contour of the stave 2 is produced is correspondingly designed such that it has a convexly curved milling region 33.

The axial length of the tools 25, 26 is larger than the width 14 of the stave 2 that is thus machined across the entire width by the two tools 25, 26.

As it is fed through the machine, the stave 2 is also machined by a top tool 34 (FIG. 6). With the tool 34, the narrow side 35 which is oppositely positioned to the narrow side 23 is machined. Since the narrow side 35 is positioned at an angle to the horizontal, the axis of rotation 36 of the tool 34 is also correspondingly arranged at an inclination.

The tool 34 is a planning tool that is driven in rotation about its axis 36 and that planes the narrow side 35.

Since the stave 2 is curved across its length, the tool 34 has such an axial length that it can machine the curved narrow side 35 across the length of the stave 2. In this way, an adjustment of the tool 34 in the direction of its axis of rotation 36 is not required for machining the stave 2.

Advantageously, the tool 34 is located in feed direction 27 behind the two tools 25, 26. For adaptation to staves 2 of different widths, the top tool 34 is adjustable in relation to the machine table on which the stave 2 is supported during its passage through the machine. In addition, the tool 34 for adaptation to different angles of inclination of the narrow side 35, is also adjustable in regard to its inclination so that the axis of rotation 36 of the tool 34 can be adapted to various angles of inclination of the narrow side 35. For a desired diameter of the barrel to be produced, the number of required staves is derived from the width of the individual staves and the angle of inclination of the narrow side 35 is derived from the number of the staves.

Figure 7:
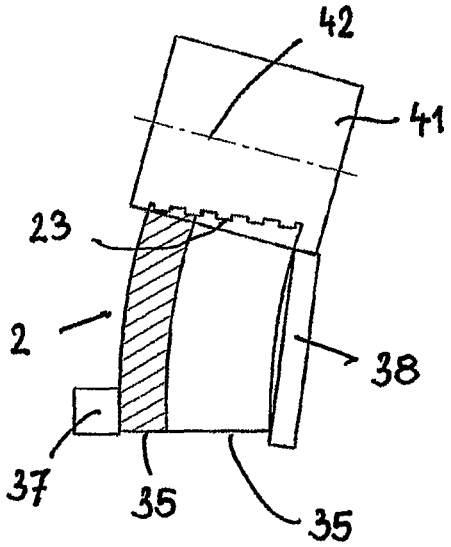
FIG. 7 shows in schematic illustration two guides for the stave that is machined with a top tool.
Figure 9:
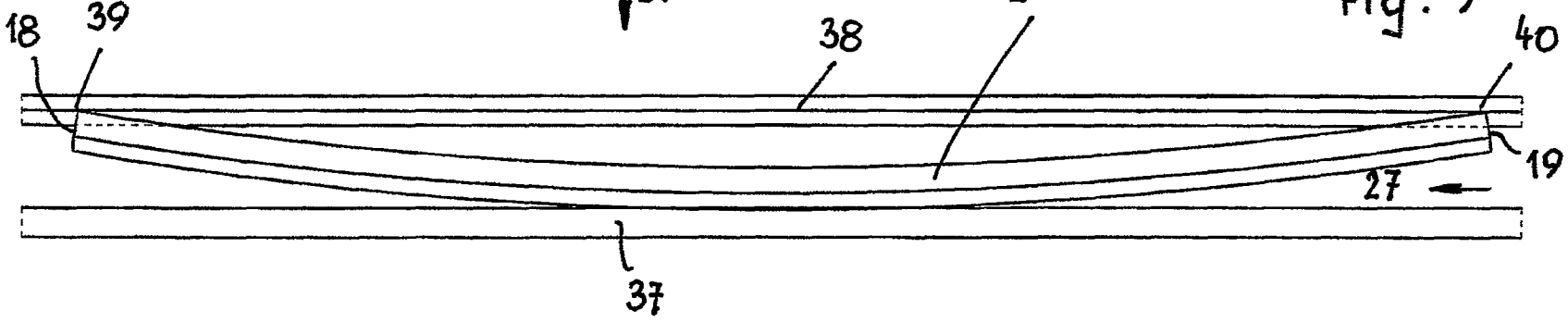
FIG. 9 shows in schematic illustration machining of the stave according to the invention on a second processing machine.

After passage through the machine, the stave 2 is finish-machined by means of the tools 25, 26, 34 at the inner and outer contours as well as at the narrow side 35. On a second machine, the narrow side 23 with the grooves 24 is subsequently machined. For this purpose, the partially finish-machined stave 2 is turned such that it is resting with its machined narrow side 35 on the machine bed of the second machine. In contrast to the first machine, this machine bed has no projecting webs. For guiding the stave 2, a left guide 37 as well as a right stop 38 are provided (FIGS. 7 and 9). The guide 37 extends parallel to the feed direction 27 and is resting on the machine bed. Viewed in feed direction 27, the stave 2 is contacting this left guide 37 approximately at half the length at the highest point of the convex curvature.

The stave 2 is contacting with its two ends the oppositely positioned stop 38, as can be seen in FIG. 9.

The stop 38 extends also in feed direction 27 and is inclined such that the stave 2 is contacting it in the region of its end face 18 and near the end face 19. Since the side of the stave 2 which is facing the stop 38 is concavely curved, the stave 2 is contacting the stop 38 only with its end regions 39, 40.

The stop 38 has a larger height than the guide 37 (FIG. 7).

It is advantageous when the stop 37 is provided so as to be adjustable transverse to the feed direction 27 at the machine so that it can be adapted to staves 2 that are curved differently. Moreover, it is advantageous when the inclination of the stop 38 can be adjusted for adaptation to different angles of inclination of the narrow side.

For machining staves 2 of different widths, it is expedient that the stop 38 has a height that corresponds to the largest width of the stave.

The narrow side 23 of the stave 2 comprising the grooves 24 is machined with a tool 41 that is rotatably driven about its axis 42 and preferably is a planning tool with which the narrow side 23 is milled such that the grooves 24 are removed. The axis of rotation 42 of the tool 41 is arranged at an inclination such that the narrow side 23 can be machined with the corresponding angle of inclination.

The axial length of the tool 41 is so large that the narrow side 23 can be machined across the entire length of the stave 2 without the tool 41 having to be adjusted.

For adaptation to staves 2 with different widths, the tool 41 is advantageously adjustable transverse to the machine table in regard to height.

It is additionally advantageous that also the inclination of the tool 41 can be adjusted so that also narrow sides 23 of the staves 2 that are positioned at different inclinations can be machined.

The second machine has, like the first machine, feed elements with which the stave 2 can be transported through the machine. The feed elements are advantageously feed rollers which rest, as is known, on the narrow side 23 of the stave 2 and transport it in the feed direction 27 while it is resting on the machine table. The stave 2 in this context is supported in the described manner at the guide 37 and at the stop 38 that are located at oppositely positioned sides of the upright standing stave 2. Advantageously, the feed rollers are also positioned at an inclination and are adjustable or pivotable in regard to the inclination in correspondence to the angle of inclination of the narrow side so that they are properly resting on the entire narrow side 23. In this context, it must be taken into consideration that the inclination is different before and after machining by the tool 41.

The finish-machined staves (FIG. 5) are then joined together to the wooden barrel 1 in the known manner. In this context, neighboring staves are positioned with their narrow sides 23, 35 abutting each other. For increasing the seal-tightness and simplifying assembly, the narrow sides 23, 35 can be provided with form fit elements in order to achieve, for example, a v-shaped tongue and groove connection. In this case, the tools 36, 41 that machine the narrow sides 23, 35 are no planning tools but profiling tools with which the corresponding form fit elements can be produced across the length of the narrow sides 23, 35. For this situation, the tools 34, 41 are adjustable in a controlled manner transverse to the feed direction 27 in the direction of their axis of rotation 36, 42 during passage of the stave 2 through the machine in order to provide the corresponding form fit elements across the curved length of the narrow sides 23, 35.

For increasing the seal-tightness, the narrow sides 23, 35 can be connected by means of glue or the staves can be assembled with intermediate positioning of sealing elements.

The production of the wooden barrels 1 by means of the staves 2 saves very much raw material because the staves 2 can be assembled of individual segments 2*a* to 2*e*. In this way, remnants can be utilized for producing the staves 2. The wood remnants that are often produced in wood machining can be used in this manner optimally for producing the staves 2 and thus the wooden barrels 1. Also, the raw wood can be more effectively utilized because comparatively short pieces can be employed which are of a high quality and without cracks and can be sawed from the raw wood without losses in regard to a beneficial fiber course. In contrast thereto, when using single-piece raw staves only a percentage of the log can be utilized in order to obtain the raw staves in the required quality without cracks and with appropriate fiber course.

The end face connection of the segments 2*a* to 2*e* can be performed with and without adhesive agent.

Since for the production of the staves 2 remnants or short and sawed raw wood pieces can be employed, the wooden barrel 1 can be produced very cost-efficiently without this being associated with disadvantages in regard to stability or seal-tightness.

In an alternative embodiment, the form fit elements 3, 4 can also be designed such that a keyhole profile results. Such a design of the form fit elements 3, 4 also enables an angled positioning of the segments 2*a* to 2*e* next to each other.

A further possibility resides in introducing finger joints into the end faces of the segments 2*a* to 2*e*. In this case, abutting segments 2*a* to 2*e* engage each other with their finger joint elements. Such a finger joint connection is then realized by means of an adhesive so that the segments 2*a* to 2*e* abutting each other are fixedly connected to each other.

Moreover, also separate connecting elements can be employed as they are used, for example, in the furniture or frame industry, e.g. double dovetail/double wedge. Then, in the individual segments only the corresponding counter shape must be provided as a recess.

Machining of the end face form fit elements can be realized with conventional processing methods and machines, for example, double end tenoners, CNC machining centers, mortising and tenoning machines.

Since the staves 2 are produced from the segments 2*a* to 2*e* which are placed at an angle against each other and are already machined with the intended curvature, the manufacturing costs of the wooden barrel are further reduced because the work step of shaping the barrel, as it is required in conventional wood barrel manufacture, is obsolete. In particular, breakage of wood is avoided which often occurs during barrel shaping.

Barrel shaping is realized in conventional wood barrel manufacture by hammer blows which is correlated with great noise and significant use of force. By eliminating this shaping process by means of hammer blows, occupational safety is significantly increased.

Since the raw stave is machined with the tools 25, 26; 34, 41, the segments 2*a* to 2*e* must not have exactly the same thickness and/or width. With the tools 25, 26; 34, 41 unequal thicknesses and/or widths are eliminated.

There is also the possibility to form straight raw staves from the segments. In this case, the end faces 5, 15 of the segments 2*a* to 2*e* are positioned perpendicularly to the top and bottom sides 21, 22. The segments 2*a* to 2*e* are positioned aligned with each other one after the other in the assembled state. In this case, the same advantages as have been described above result also with respect to the wood yield. Since the staves are initially straight, they are bent by a shaping process as in the above described process of barrel shaping into the shape that is required for producing the wooden barrel 1.

The straight staves are machined in the known manner in a linear straight throughfeed process. In order to produce the required waisting of the stave, the tools are adjusted in a controlled manner transverse to the feed direction during the throughfeed action. The tools are arranged at an inclination in accordance with the desired inclination of the narrow sides and, as needed, can also be adjusted in a controlled manner in regard to their inclination during the throughfeed action of the stave 2.

The advantage of the use of curved raw staves that already have the assembly-ready curvature, resides also in the described simpler machining. The tools for processing the narrow sides must only be adjusted radially, axially and in regard to the inclination but remain rigid during the passage of the stave through the machine and must not be adjusted in a controlled manner. This significantly reduces the control expenditure and the expenditure for recording the workpiece position during the throughfeed action. Directly after machining, the staves have the planar narrow sides with which they are resting tightly against each other upon assembly of the barrel.

For forming the curved raw stave, instead of straight segment pieces which are machined at end faces at an angle and are resting against each other angularly, it is also possible to use segments that are curved in length direction which are joined together at end faces at a right angle but also at a different angle.

After assembling the staves 2, milled slots for a cover can be provided at the upper and/or lower end.

For a high quality appearance, the visible outer side of the staves 2 can be ground.

It is moreover possible, after or prior to assembly of the staves 2 to the wooden barrel 1, to char or roast or toast the parts at the inner side by means of a thermal treatment (flame treating, roasting, toasting). This treatment provides advantages in respect to affecting the taste (barrique taste) of a wine which is stored in the wooden barrel 1.

For enhancing the barrique taste, at the inner side of the stave 2 can be provided for surface enlargement slots or perforations.

In a different method, for machining the raw staves, the narrow side 23 with the grooves 24 can already be machined in the first machine. It comprises an additional lower spindle on which a planning tool is seated with which the grooves 24 can be removed in the described manner. The spindle is arranged with appropriate inclination. The machine table or the workpiece support is advantageously also inclined in the region behind this lower spindle. Alternatively, the workpieces in the region of this lower spindle can be received by a transport unit by means of which they are transported in the feed direction for machining.

In another embodiment, the top and bottom sides 21, 22 of the raw stave 2 are machined in the described manner on the first machine. The second machine is designed such that special support elements pick up the curved partially machined or raw stave 2 in an exact position from below and transport them linearly through the second machine. For transportation, the machine is provided with a chain feed action at which the support elements are provided. During this feed action, the staves are machined at their narrow sides 23, 35 during the throughfeed action by right and left tools that are arranged at an inclination. The staves 2 can be supplied, for example, by robots and can be removed by robots. In a further embodiment, on the first machine advantageously again the top and bottom sides 21, 22 of the staves 2 are machined in the described manner. The second machine has a machine table which has a support for the stave 2 that is curved corresponding to the curvature of the stave 2. The staves 2 are not transported linearly through the machine but along the machine table that is curved in feed direction. The stave 2 is machined at its narrow sides 23, 35 with a left and right tool during its passage. In order to produce the required waisting of the stave, the tools are adjusted in a controlled manner transverse to the feed direction during the throughfeed action. The tools are arranged at an inclination in correspondence to the desired inclination at the narrow sides and, as needed, can also be adjusted in a controlled manner in regard to their inclination during passage of the stave 2 through the second machine. This method, as described, is known in today's machining of straight staves.

What is claimed is:

1. A stave for producing wooden barrels, the stave comprising individual segments, each individual segment comprising oppositely arranged end faces, wherein the individual segments are fixedly connected at the end faces to each other.

2. The stave according to claim 1, wherein the individual segments are connected by a form fit connection to each other, respectively.

3. The stave according to claim 2, wherein the form fit connection is a tongue and groove connection or a finger joint connection.

4. The stave according to claim 1, wherein the individual segments are straight, respectively.

5. The stave according to claim 1, wherein at least one of the oppositely arranged end faces of the individual segments is an inclined end face that is inclined at an acute angle relative to a plane extending perpendicularly to a top side or a bottom side of the individual segment.

6. The stave according to claim 5, wherein the individual segments are connected by a form fit connection to each other, respectively, wherein the form fit connection is designed such that the inclined end faces of neighboring individual segments are resting flat against each other.

7. The stave according to claim 1, comprising narrow sides with form fit elements configured to engage a narrow side of another stave.

8. A wooden barrel comprising staves according to claim 1, wherein the staves each comprise opposite narrow sides and wherein the opposite narrow sides of the staves are seal-tightly placed against each other.

9. A method for producing a stave according to claim 1, the method comprising:

joining together the individual segments, with the oppositely arranged end faces resting against each other, to a raw stave.

10. The method according to claim 9, further comprising machining the oppositely arranged end faces of the individual segments such that the individual segments after joining together are positioned at an angle relative to each other so that the raw stave is curved across a length of the raw stave.

11. The method according to claim 10, further comprising machining in a throughfeed method a top side and a bottom side of the raw stave for forming an outer side that extends convexly across a length of the raw stave and an inner side that extends concavely across the length of the raw stave.

12. The method according to claim 11, further comprising transporting the raw stave linearly through the machine.

13. The method according to claim 12, further comprising guiding the raw stave at a first longitudinal side and at a second longitudinal side in a feed direction through the machine.

14. The method according to claim 12, further comprising guiding the raw stave at a stop, provided in a region of ends of the raw stave, in a feed direction through the machine.

15. The method according to claim 12, further comprising providing a guide extending in a feed direction through the machine such that the guide is resting against the outer side of the raw stave.

16. The method according to claim 9, further comprising transporting the raw stave through a machine with a first narrow side of the raw stave resting on a support and machining, as the raw stave is transported through the machine, a first longitudinal side forming an outer side of the raw stave and a second longitudinal side forming an inner side of the raw stave with at least one tool.

17. The method according to claim 16, wherein the at least one tool includes a first tool and a second tool, wherein the outer side that is convex transverse to a length direction of the raw stave is produced with the first tool and the inner side of the raw stave that is concave transverse to the length direction of the raw stave is produced with the second tool.

18. The method according to claim 16, further comprising machining a second narrow side of the raw stave, the second narrow side oppositely positioned to the first narrow side, with at least one additional tool.

19. The method according to claim 16, further comprising providing the first narrow side with at least one guide groove extending in a feed direction of feeding the raw stave through the machine.

20. The method according to claim 19, further comprising turning the raw stave after having passed through the machine such that in a further machining step the at least one guide groove in the first narrow side is removed by a tool.

* * * * *